US007439433B1

(12) United States Patent
Hsieh

(10) Patent No.: US 7,439,433 B1
(45) Date of Patent: Oct. 21, 2008

(54) SNARE DRUM STRAINER

(75) Inventor: Wu-Hong Hsieh, Lu Chou (TW)

(73) Assignee: K.H.S. Musical Instrument Co., Ltd. (TW)

( * ) Notice: Subject to any disclaimer, the term of this patent is extended or adjusted under 35 U.S.C. 154(b) by 12 days.

(21) Appl. No.: 11/790,700

(22) Filed: Apr. 27, 2007

(51) Int. Cl.
*G10D 13/02* (2006.01)

(52) U.S. Cl. ..... 84/415; 84/411 R

(58) Field of Classification Search ..... 84/415, 84/416, 417, 411 R
See application file for complete search history.

(56) References Cited

U.S. PATENT DOCUMENTS 5,557,053 A * 9/1996 Nickel ..... 84/415
6,020,547 A * 2/2000 Chen ..... 84/415
7,365,256 B2 * 4/2008 Takegawa ..... 84/415
2006/0219084 A1 * 10/2006 Dunnett ..... 84/415
2007/0079686 A1 * 4/2007 Hsieh ..... 84/415

* cited by examiner

*Primary Examiner*—Lincoln Donovan
*Assistant Examiner*—Jianchun Qin
(74) *Attorney, Agent, or Firm*—Hershkovitz & Associates, LLC; Abe Hershkovitz

(57) ABSTRACT

A snare drum strainer includes a switch stand, a brake part, a suspender steady base and a pull handle driven part. The brake part can slide inside the switch stand and also can move upward and downward. The suspender steady base is steady located at a lower end of the brake part for clipping multiple snares. The pull handle driven part is pivotally coupled to the switch stand for controlling the brake part to be ascending and descending. The brake part makes use of a self-lubricating bearing and a shaft sleeve to generate a self-lubricating effect. Further, the pull handle driven part makes use of a bolt and a spacer to have the pull handle, the driven buttons and the driven pole pivotal coupled together. When the suspender steady base is in use, friction can be reduced, so as to enhance the fluid movement and further reduce the noise.

14 Claims, 6 Drawing Sheets

SNARE DRUM STRAINER

BACKGROUND OF THE INVENTION

1. Field of the Invention

The invention relates in general to a snare drum strainer, and more particularly to a snare drum strainer that can have an effortless and fluid movement, so as to effectively reduce a noise of the strainer.

2. Description of the Related Art

With reference to FIG. 5, a conventional snare drum includes a cylindrical shell 70 made of wood, metal or plastic etc. material, drum heads 71, multiple snares 72 and a side-throw strainer. The drum heads 71 are stretched across both openings of the drum's shell 70. The snares 72 are stretched across the bottom drum head 71. When the top of the drum head 71 is struck, causing a sudden increase in pressure within the instrument, the snares 72 vibrate against the bottom head 71. This produces a short, distinctive and snap-like sound. The snares 72 can be disengaged if this effect is not wanted. The side-throw strainer 80 with dual fine adjustment on the throw and butt side allows infinite adjustment of the snares 72.

With reference to FIG. 6, the conventional strainer 80 includes a switch stand 81, an escalator 82, a driven block 83, a pull handle 84, several driven buttons 85 and a suspender steady base 86.

The switch stand 81 is of a hollow form with a circular hole on a top and a trough slot on a bottom.

The escalator 82 has a shaft 82 land an adjustment block 822. The shaft 821 forms a circular shape. An upper end of the shaft 821 is through the hole of the switch stand 81. A cross-section of the adjustment block 822 forms a T-shaped. An upper face of the adjustment block 822 is connected to a bottom end of the shaft 821, and a lower face of the adjustment block 822 is through the matching trough slot of the bottom of the switch stand.

The shaft 821 passes through the driven block 83 along a vertical direction. On the other hand, the driven block 83 is horizontally through an opening formed on a side wall of the switch stand 81.

The pull handle 84 includes a lower end pivoted on the sidewall of the switch stand 81. That is, the pull handle 84 is pivotally connected to the driven block 83 through the two driven buttons 85. Hence the two driven buttons 85, the driven block 83 and the pull handle 84 are pivotally coupled together.

The suspender steady base 86 is used to clip snares (not shown in the diagram). A body of the suspender steady base 86 is coupled to the adjustment block 822, so as to be ascending or descending along with the escalator 82.

When the pull handle 84 is pulled apart from the switch stand 81, the escalator 82 makes the suspender steady base 86 descend. At this moment the snares on the suspender steady base 86 is loose. When the pull handle 84 is pulled inward, the driven bock 83 is pushed upward by the driven buttons 85. Hence the driven block 83 drives the escalator 82 to ascend, so as to tighten the snares on the suspender steady base 86.

Although the aforesaid strainer 80 can be used to fasten the snares easily, the escalator 82 slides inside an unmatched space of the switch stand 81. In this way, the strainer can not have a fluid movement and also may produce a noise. Furthermore, the product value of the strainer may be reduced.

SUMMARY OF THE INVENTION

An objective of the present invention is to provide a snare drum strainer that has an effortless and fluid movement, so as to effectively reduce a noise of the strainer.

In order to achieve the above objective, the snare drum strainer in accordance with the present invention has a switch stand, a brake part, a suspender steady base and a pull handle driven part.

The switch stand forms a hollow cylindrical shape having a top of a closed end with an opening on the top and a bottom of an open form. A steady part extending outward is formed on a first external sidewall of the switch stand for fastening to a drum body. A second external sidewall opposite to the first external sidewall of the switch stand includes a long opening parallel to an axis and two opposite pivot parts extending outward. Each of the pivot parts comprises a pivot hole.

The brake part installed inside the switch stand includes a self-lubricating bearing, a shaft sleeve and a tie bar. The self-lubricating bearing includes an axial opening and a radial opening. The axial opening includes a circular opening section and a square opening section. An adjustment spiral pole is installed inside the axial opening. An upper end of the adjustment spiral pole is a non-spiral section passing through the circular opening section of the axial opening, and a lower end of the adjustment spiral pole is located inside the square opening section. The shaft sleeve is of a tubular shape mounted on the self-lubricating bearing to be fastened inside the switch stand. The tie bar is of a square pillar shape which matches the square opening section of the self-lubricating bearing. The tie bar is located inside the square opening section. The tie bar includes a third spiral opening through both ends of the tie bar along an axial direction. An upper end of the tie bar is spiral coupled to multiple screws of the adjustment spiral pole.

The suspender steady base includes a base body and a base clamp. The base body is spirally coupled to a bottom of the tie bar to be driven to ascend or descend by the brake part. The base body is spirally coupled to the base clamp for clipping the snares in-between the base body and the base clamp.

The pull handle driven part includes a pull handle, two driven buttons and a driven pole. One end of the driven pole inserts into the radial opening of the self-lubricating bearing through the opening of the switch stand, and the other end of the driven pole includes a pivotal hole to make the driven pole coupled to the two driven buttons. A first pivotal connection part and a second pivotal connection part are formed at a lower internal side of the pull handle. The first pivotal connection part at a lower end of the pull handle is pivotal coupled to the pivot part of the switch stand, and the second pivotal connection part is pivotal coupled to the other end of the two driven buttons.

The brake part makes use of the self-lubricating bearing and the shaft sleeve to generate a self-lubricating effect. In this way, when the suspender steady base is in use, friction can be reduced, so as to enhance the fluid movement and further reduce the noise. On the other hand, the pull handle driven part makes use of a bolt and a spacer to have the pull handle, the driven buttons and the driven pole pivotal coupled together. Therefore an operation for each component of the pull handle driven part can have an effortless and fluid movement, so as to effectively reduce the noise of the strainer.

DETAILED DESCRIPTION OF THE INVENTION

Figure 1:
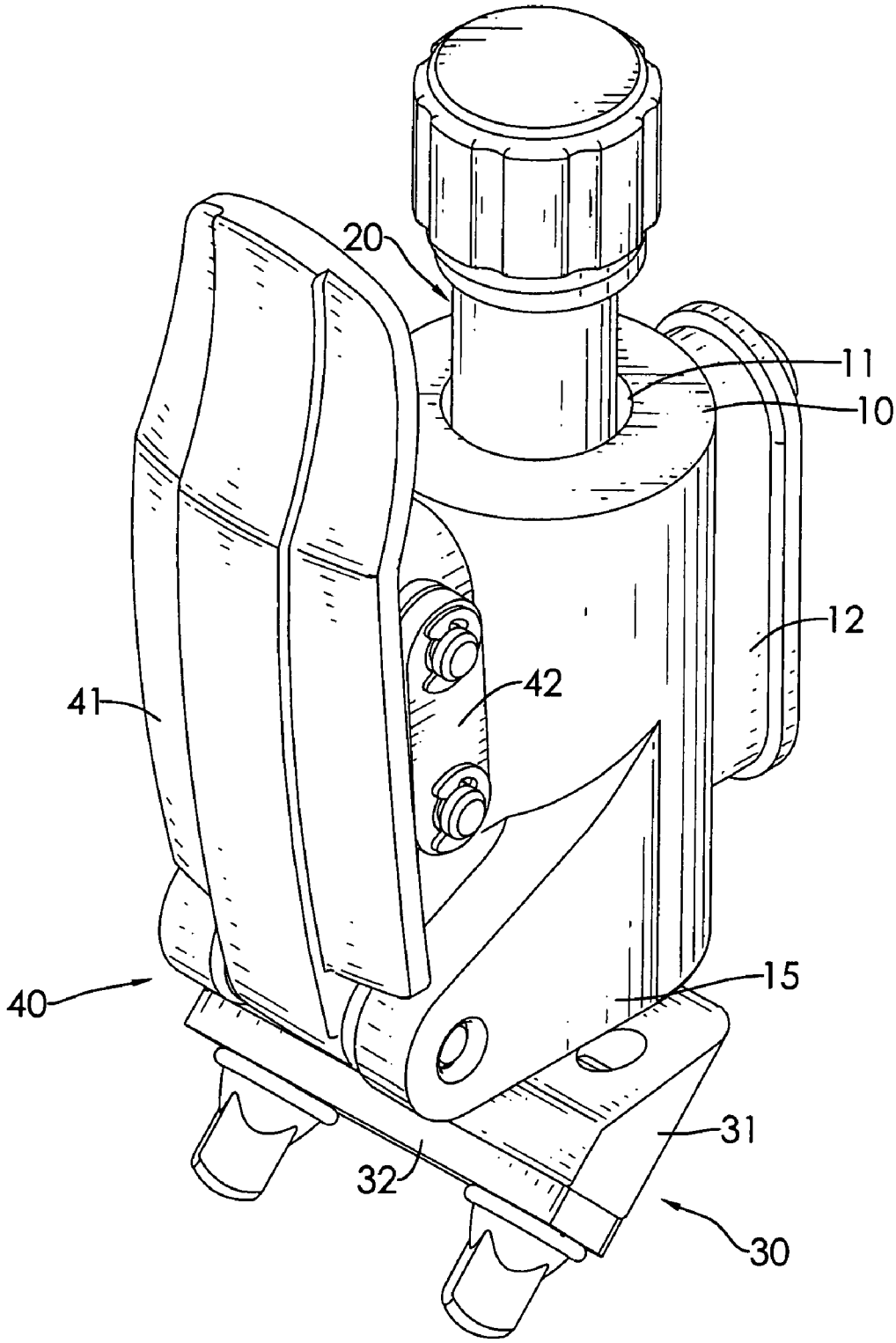
FIG. 1 is perspective view of a snare drum strainer in accordance with the present invention.

With reference to FIG. 1, an external appearance diagram of a snare drum strainer of a preferred embodiment in accordance with the present invention has a switch stand 10, a brake part 20, a suspender steady base 30 and a pull handle driven part 40. The brake part 20 slides inside the switch stand 10 and also moves upward and downward. The suspender steady base 30 is steady located at a lower end of the brake part 20 for clipping multiple snares. The pull handle driven part 40 is pivotally coupled to the switch stand 10 for controlling the brake part 20 to be ascending and descending.

Figure 2:
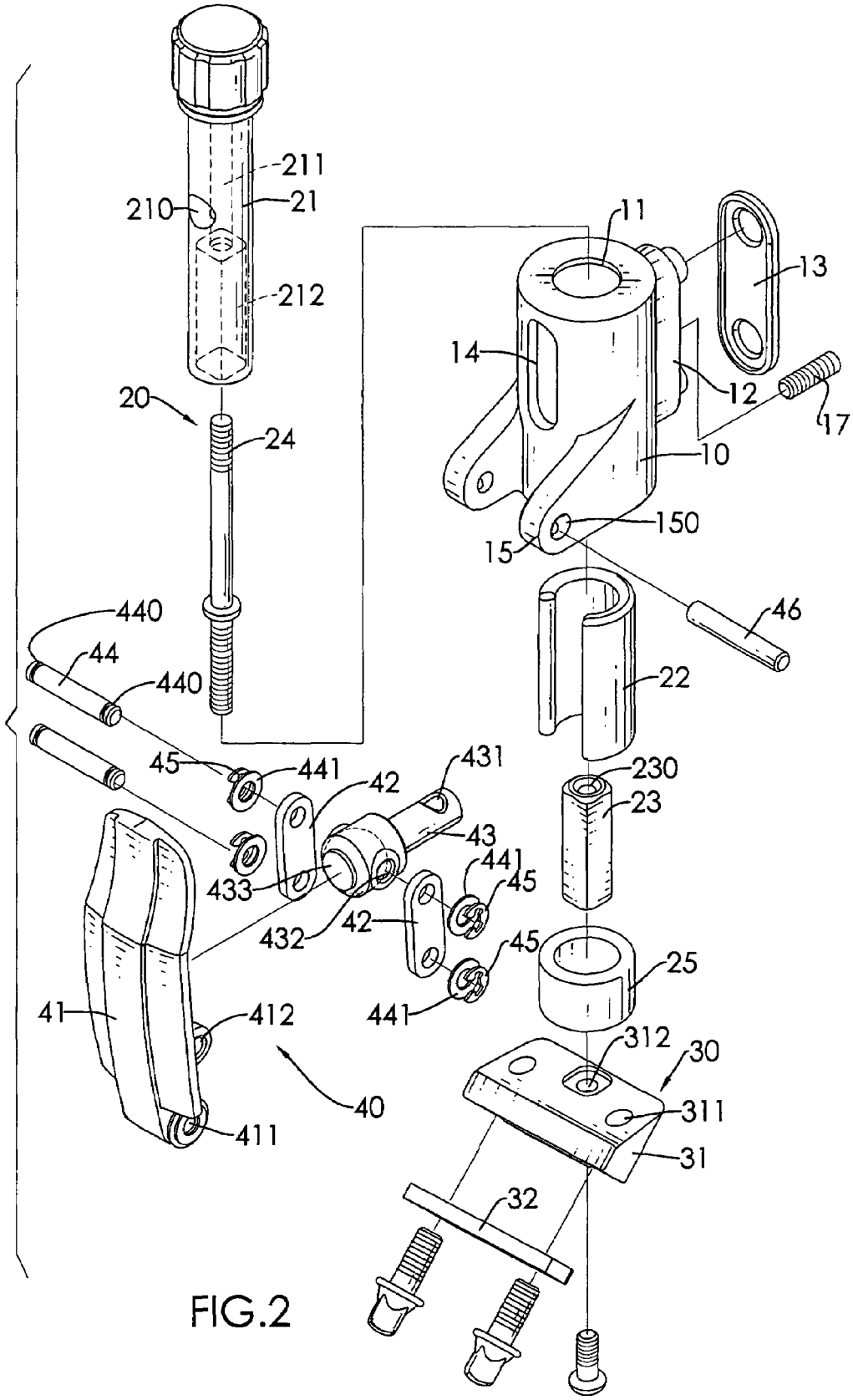
FIG. 2 is an exploded perspective view of the snare drum strainer in accordance with the present invention.
Figure 3:
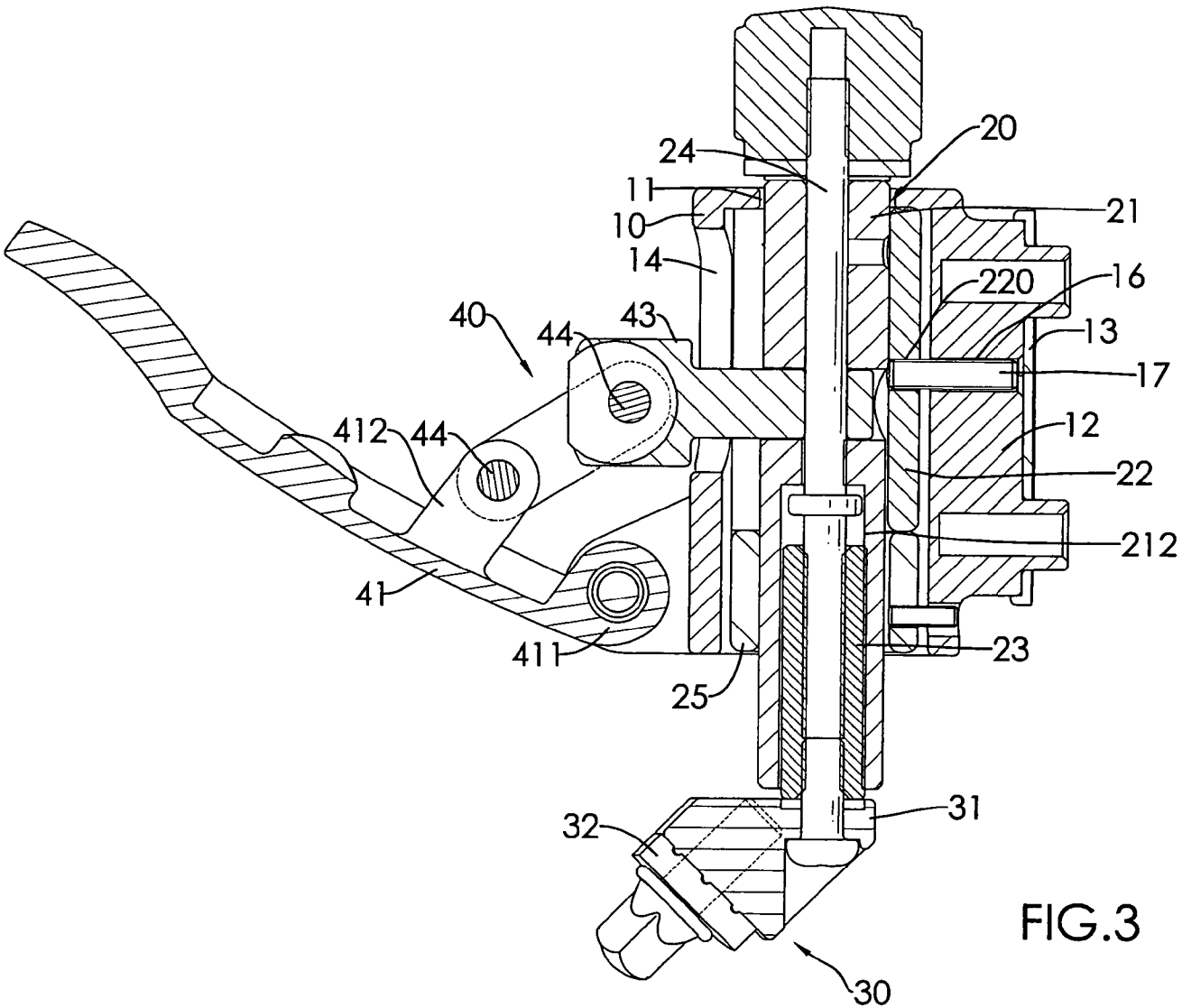
FIG. 3 is a cross sectional view of the snare drum strainer in accordance with the present invention.

With reference to FIGS. 2 and 3, the switch stand 10 forms a hollow cylindrical shape. A top of the switch stand 10 defines an opening 11 and a bottom of the switch stand 10 is of an open form. An elliptic steady part 12 extending outward is formed on a first external sidewall of the switch stand 10. A steady plate 13 is connected to the steady part 12, so the steady part 12 fastens to a drum body (not shown in the diagram) through the steady plate 13. The steady part 12 further includes a first spiral opening 16. A second external sidewall of the switch stand 10 includes a long opening 14 parallel to an axis and two opposite pivot parts 15 extending outward. The second external sidewall is opposite to the first external sidewall. Each of the pivot parts 15 includes a pivot hole 150 to make the pull handle driven part 40 pivotally coupled together.

The brake part 20 is installed inside the switch stand 10 including a self-lubricating bearing 21, a shaft sleeve 22 and a tie bar 23. The self-lubricating bearing 21 forms a circular tubular shape having a vertical opening and a horizontal opening 210. The vertical opening passes through two ends of the self-lubricating bearing 21 along an axial direction and includes an upper circular opening 211 and a lower square opening 212 communicating with the upper circular opening. Moreover, an adjustment spiral pole 24 is installed inside the vertical opening and has an upper non-spiral section and a lower spiral section. The upper non-spiral section is passing through the circular opening section 211 of the vertical opening. The lower spiral section is located inside the lower square opening 212, so as to be spiral coupled with the tie bar 23. Further, the shaft sleeve 22 includes a second spiral opening 220 laterally defined through a sidewall of the shaft sleeve 22 opposite to the first spiral opening 16 of the steady part 12 of the switch stand 10. The second spiral opening 220 is corresponding to the first spiral opening 16 on the steady part 12, so as to make a spiral pole 17 fixed inside the switch stand 10.

Further, the tie bar 23 is of a square pillar shape which matches the lower square opening 212. The tie bar 23 passes through the lower square opening 212 without arbitrarily rotation. The tie bar 23 includes a third spiral opening 230 through both ends of the tie bar 23 along an axial direction. An upper end of the tie bar 23 is spirally coupled to multiple spirals of the adjustment spiral pole 24 through the third spiral opening 230. The shaft sleeve 22 is of a tubular shape which forms a C-shape from a top view. An internal diameter of the shaft sleeve 22 matches an external diameter of the self-lubricating bearing 21, so that the self-lubricating bearing 21 goes through the shaft sleeve 22. Moreover, a lower end of the self-lubricating bearing 21 is mounted with a tubular ring 25. The tubular ring 25 is also fixed inside the switch stand 10.

The suspender steady base 30 includes a base body 31 and a base clamp 32. The base body 31 forms a chunk shape having two ends, each of which defines a fourth spiral opening 311. The base body 31 is spirally coupled to the base clamp 32 by a first spiral pole passing through the spiral opening 311 respectively on the two ends of the base body 31. Hence the snares can be clipped by the base body 31 and the base clamp 32. Moreover, a positing hole 312 is formed on a center of the base body 31. A second spiral pole can be used to make the base body 31 spirally coupled to a bottom of the tie bar 23, so that the base body 31 can be driven to ascend or descend by the brake part 20.

The pull handle driven part 40 has a pull handle 41, two driven buttons 42 and a driven pole 43. One end of the driven pole 43 inserts into the horizontal opening 210 of the self-lubricating bearing 21 through the long opening 14 of the switch stand 10. A radial hole 431 formed at the end of the driven pole 43 is passed through by the upper non-spiral section of the adjustment spiral pole 24 inside the self-lubricating bearing 21. Moreover, the driven pole 43 defines a pivotal hole 432. A bolt 44 is pivotal coupled inside the pivotal hole 432. Two buckling troughs 440 are respectively formed on corresponding end of the bolt 44. A spacer 441 is mounted on each buckling trough 440. In this way, each end of the two driven buttons 42 is mounted on the bolt 44 with the pivotal hole 432, so as to make an E-shaped buckling ring 45 buckled with the buckling trough 440 of the bolt 44. Hence the driven pole 43 is coupled to the two driven buttons 42. Further, a cushion pad 433 is formed on an external side of the driven pole 43 to absorb a shock when the pull handle 41 contacts the driven pole 43, so as to avoid noise.

A first pivotal connection part 411 and a second pivotal connection part 412 of a ring shape are formed at a lower internal side of the pull handle 41. The first pivotal connection part 411 at a lower end of the pull handle 41 is pivotal coupled to the two opposite pivot parts 15 of the switch stand 10 with a pivotal pole 46. On the other hand, the second pivotal connection part 412 is pivotal coupled to the other end of the two driven buttons 42 by the bolt 44, the spacer 441 and the E-shaped buckling ring 45. The pull handle driven part 40 makes use of the bolt 44 and the spacer 441 to have the pull handle 41, the driven buttons 42 and the driven pole 43 pivotal coupled together. Therefore an operation for each component of the pull handle driven part 40 can have an effortless and fluid movement, so as to effectively reduce a noise of the strainer.

Figure 4:
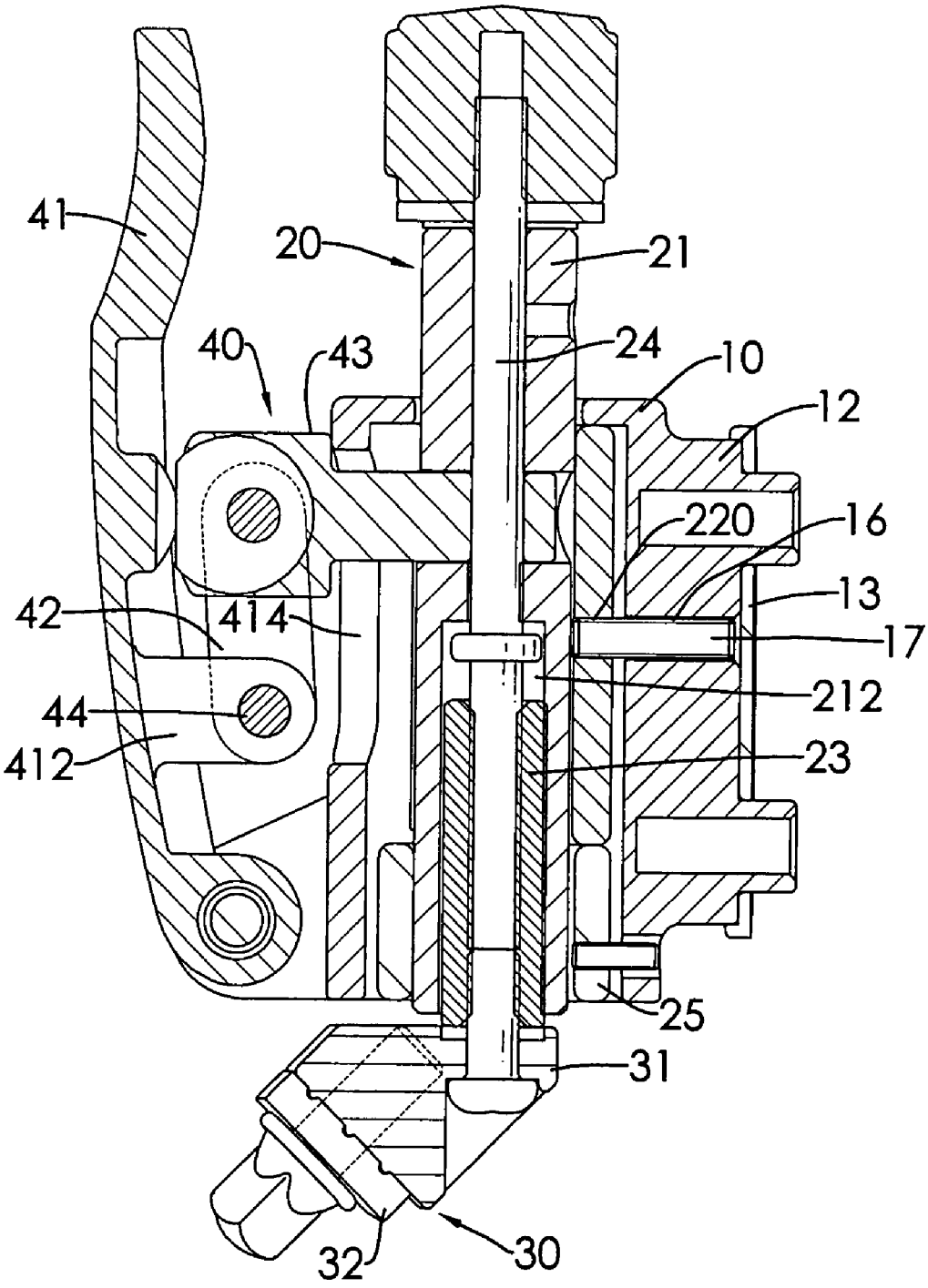
FIG. 4 is another cross sectional view of the snare drum strainer in accordance with the present invention.
Figure 5:
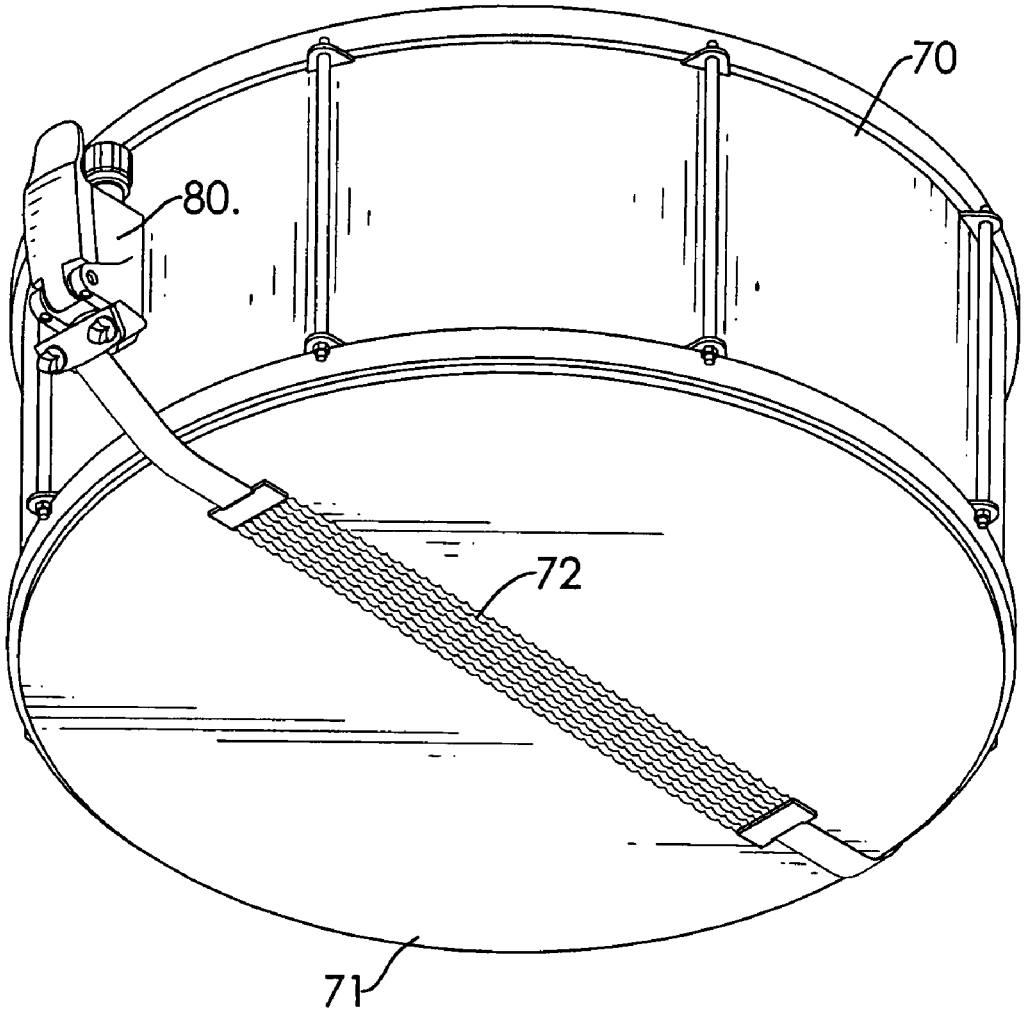
FIG.5 PRIOR ART
FIG. 5 is a perspective view of a conventional snare drum and a snare strainer thereof in accordance with the prior art.
Figure 6:
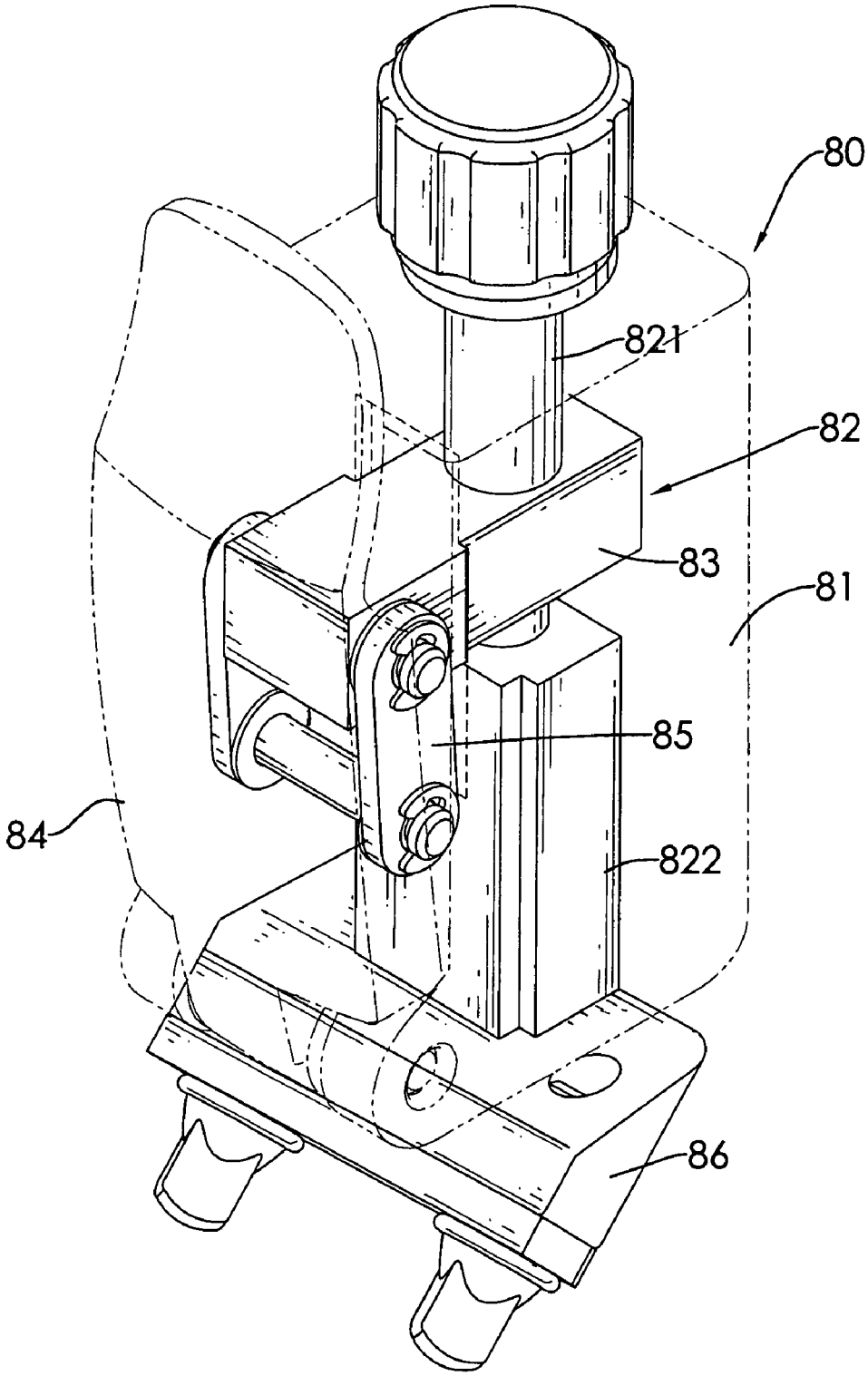
FIG.6 PRIOR ART
FIG. 6 is a perspective view of a conventional snare strainer in accordance with the prior art.

A preferred embodiment structure of the snare drum strainer in accordance with the present invention can be understood based on the foregoing description. An operation of the present invention is further described, with reference to FIGS. 3 and 4.

When the pull handle 41 of the pull handle driven part 40 is pulled outward, the brake part 20 is descending. At this moment, the suspender steady base 30 coupled with the brake part 20 is also descending. Hence suspenders of the snares can be clipped on the suspender steady base 30. At this moment the snares on the suspender steady base 30 is loose. When the pull handle 41 is pulled inward, the pull handle 41 pushes the driven pole 43 upward by the driven buttons 42, so as to drive the brake part 20 to push upward. Since the suspender steady base 30 is also moved upward along with the brake part 20, the snares on the suspender steady base 30 is tightened.

According to the aforesaid structure of the present invention, the brake part 20 makes use of the self-lubricating bearing 21 and the shaft sleeve 22 to generate a self-lubricating effect. In this way, when the suspender steady base 30 is in use, friction can be reduced, so as to enhance the fluid movement and further reduce the noise. On the other hand, the pull handle driven part 40 makes use of the bolt 44 and the spacer 441 to have the pull handle 41, the driven buttons 42 and the driven pole 43 pivotal coupled together. Therefore an operation for each component of the pull handle driven part 40 can have an effortless and fluid movement, so as to effectively reduce the noise of the strainer.

Therefore the snare drum strainer of the present invention improves the convention snare drum strainer, which can not have a fluid movement and also may produce a noise. Furthermore, the product value of the strainer may be reduced. Hence the snare drum strainer of the present invention indeed includes features of good utility and unobviousness to meet the requirements of a patent.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A snare drum strainer comprising:

a switch stand forming a hollow cylindrical shape and having a top with an opening, a bottom, a first sidewall and a second sidewall being opposite to the first sidewall, wherein the switch stand further has a steady part extending outward from the first external sidewall for fastening to a drum body;

a long opening parallel to an axis and defining through the second external sidewall; and two opposite pivot parts extending outward from the second external sidewall, each of which defines a pivot hole;

a brake part installed inside the switch stand and comprising a self-lubricating bearing having a vertical opening consisted of a upper circular opening and a lower square opening, wherein an adjustment spiral pole is installed inside the vertical opening and has an upper non-spiral section passing through the upper circular opening and a lower spiral section located inside the lower square opening; and a horizontal opening;

a shaft sleeve being of a tubular shape and mounted on the self-lubricating bearing to be fastened inside the switch stand; and a tie bar being of a square pillar shape and matches the lower square opening of the self-lubricating bearing to locate inside the lower square opening, wherein the tie bar further defines a third spiral opening through both ends of the tie bar along an axial direction, wherein an upper end of the tie bar is spirally coupled to multiple spirals of the adjustment spiral pole;

a suspender steady base comprising a base body spirally coupled to a bottom of the tie bar to be driven to ascend or descend by the brake part; and a base clamp spirally coupled to the base body for clipping snares in-between the base body and the base clamp; and a pull handle driven part comprising a driven pole having two opposite ends, wherein one end of the driven pole inserts into the horizontal opening of the self-lubricating bearing through the long opening of the switch stand, and the other end of the driven pole defines a pivotal hole;

two driven buttons, each of which has a first and second ends, wherein the first end of each driven button is pivotally connected to the driven pole; and a pull handle comprising a first pivotal connection part formed at a lower internal side of the pull handle and pivotally coupled to the two opposite pivot parts of the switch stand; and a second pivotal connection part formed at a lower internal side of the pull handle and pivotally coupled to the second ends of the two driven buttons.

2. The snare drum strainer as claimed in claim 1, wherein a lower end of the self-lubricating bearing is mounted to a tubular ring, wherein the tubular ring is also fixed inside the switch stand.

3. The snare drum strainer as claimed in claim 2, further comprising:

two pivot holes respectively defined on the corresponding first end of the two driven buttons pivotally coupled to the driven pole respectively, wherein the two pivot holes of the two first ends of the two driven buttons are aligned to the pivot of the driven pole;

a bolt having two ends and passing through the two pivot holes of the two driven buttons and the pivot hole of the driven pole, wherein two buckling troughs are defined on corresponding end of the bolt;

two spacers are respectively mounted on the corresponding buckling trough of the bolt; and an E-shaped buckling ring buckled with the buckling trough.

4. The snare drum strainer as claimed in claim 3, further comprising two pivot holes respectively defined on the corresponding second end of the two driven buttons pivotally coupled to the second pivotal connection part of the pull handle, wherein the two pivot holes of the second ends of the two driven buttons are aligned to the second pivotal connection part;

a bolt having two ends and passing through the two pivot holes of the second ends of the two driven buttons and the second pivotal connection part, wherein two buckling troughs are defined on corresponding end of the bolt;

two spacers are respectively mounted on the corresponding buckling trough of the bolt; and an E-shaped buckling ring buckled with the buckling trough.

5. The snare drum strainer as claimed in claim 4, wherein a cushion pad is formed on an external side of the driven pole.

6. The snare drum strainer as claimed in claim 4, further comprising:

a first spiral opening laterally defined through the steady part of the switch stand;

a second spiral opening defined laterally through a sidewall of the shaft sleeve corresponding to the first spiral opening of the steady part of the switch stand; and a spiral pole screwing into the steady part and the shaft sleeve through the first and second spiral openings.

7. The snare drum strainer as claimed in claim 3, wherein a cushion pad is formed on an external side of the driven pole.

8. The snare drum strainer as claimed in claim 3, further comprising:

a first spiral opening laterally defined through the steady part of the switch stand;

a second spiral opening defined laterally through a sidewall of the shaft sleeve corresponding to the first spiral opening of the steady part of the switch stand; and a spiral pole screwing into the steady part and the shaft sleeve through the first and second spiral openings.

9. The snare drum strainer as claimed in claim 1, further comprising:

two pivot holes respectively defined on the corresponding first end of the two driven buttons pivotally coupled to the driven pole respectively, wherein the two pivot holes of the first ends of the two driven buttons are aligned to the pivot of the driven pole;

a bolt having two ends and passing through the two pivot holes of the two driven buttons and the pivot hole of the driven pole, wherein two buckling troughs are defined on corresponding end of the bolt;

two spacers are respectively mounted on the corresponding buckling trough of the bolt; and an E-shaped buckling ring buckled with the buckling trough.

10. The snare drum strainer as claimed in claim 9, further comprising:

two pivot holes respectively defined on the corresponding second end of the two driven buttons pivotally coupled to the second pivotal connection part of the pull handle, wherein the two pivot holes of the second ends of the two driven buttons are aligned to the second pivotal connection part;

a bolt having two ends and passing through the two pivot holes of the second ends of the two driven buttons and the second pivotal connection part, wherein two buckling troughs are defined on corresponding end of the bolt;

two spacers are respectively mounted on the corresponding buckling trough of the bolt; and an E-shaped buckling ring buckled with the buckling trough.

11. The snare drum strainer as claimed in claim 10, wherein a cushion pad is formed on an external side of the driven pole.

12. The snare drum strainer as claimed in claim 10, further comprising:

a first spiral opening laterally defined through the steady part of the switch stand;

a second spiral opening defined laterally through a sidewall of the shaft sleeve corresponding to the first spiral opening of the steady part of the switch stand; and a spiral pole screwing into the steady part and the shaft sleeve through the first and second spiral openings.

13. The snare drum strainer as claimed in claim 9, wherein a cushion pad is formed on an external side of the driven pole.

14. The snare drum strainer as claimed in claim 9, further comprising:

a first spiral opening laterally defined through the steady part of the switch stand;

a second spiral opening defined laterally through a sidewall of the shaft sleeve corresponding to the first spiral opening of the steady part of the switch stand; and a spiral pole screwing into the steady part and the shaft sleeve through the first and second spiral openings.

* * * * *